US006029534A

United States Patent [19]

Fernandez

[11] Patent Number: 6,029,534

[45] Date of Patent: Feb. 29, 2000

[54] MANUALLY-OPERATED REMOTE-CONTROL DEVICE, ESPECIALLY HYDRAULIC MANIPULATOR

[75] Inventor: Antonio Fernandez, Saint-Priest, France

[73] Assignee: Mannesmann Rexroth S.A., Venissieux, France

[21] Appl. No.: 09/102,862

[22] Filed: Jun. 23, 1998

[30] Foreign Application Priority Data

Jun. 30, 1997 [FR] France ..... 97 08197

[51] Int. Cl.[7] ..... G05G 9/047

[52] U.S. Cl. ..... 74/471 XY; 200/6 A; 403/362

[58] Field of Search ..... 74/471 XY; 200/6 A; 403/362; 137/636.2

[56] References Cited

U.S. PATENT DOCUMENTS

| | | | |
|---|---|---|---|
| 1,262,425 | 4/1918 | Young | 403/362 X |
| 3,764,959 | 10/1973 | Toma et al. | 339/177 R |
| 5,140,320 | 8/1992 | Gerbier et al. | 74/471 XY X |
| 5,164,722 | 11/1992 | Laroze et al. | 341/20 |
| 5,184,646 | 2/1993 | Hori et al. | 137/636.2 |
| 5,224,589 | 7/1993 | Karakama et al. | 200/6 A X |
| 5,468,924 | 11/1995 | Naitou et al. | 200/6 A |

FOREIGN PATENT DOCUMENTS 2 648 580 12/1990 France .

OTHER PUBLICATIONS

French Preliminary Search Report dated Apr. 9, 1998, French Application FR 9708197.

*Primary Examiner*—Allan D. Herrmann
*Attorney, Agent, or Firm*—Marshall, O'Toole, Gerstein, Murray & Borun

[57] ABSTRACT

Manually-operated remote-control device, especially hydraulic manipulator, comprising: a body (1) containing at least one moving signal-generating member, controlled by a push-rod (2) projecting above the body (1) and movable by a rocking cam (4) fixed to the top of the body (1); means (5) of rotary articulation, comprising a fixed clevis mount (5*a*) secured to the body (1) and a moving clevis mount (5*b*) secured to the cam (4), these clevis mounts (5*a*, 5*b*) being coupled together so as to allow the cam (4) to rock with respect to the body (1); a base (6) secured to this cam and supporting an operating handgrip (7); characterized in that the moving clevis mount (5*b*) of the articulation means, the cam (4) and the base (6) are constructed in the form of a single monobloc component (14).

7 Claims, 2 Drawing Sheets

MANUALLY-OPERATED REMOTE-CONTROL DEVICE, ESPECIALLY HYDRAULIC MANIPULATOR

FIELD OF THE INVENTION

The present invention relates to improvements made to manually-operated remote-control devices comprising: a body containing at least one moving member that generates a signal when moved, especially linearly parallel to the axis of the body, between two extreme positions; at least one push-rod associated with the said generating member and projecting from the top of the body, this push-rod being guided so that it can move substantially axially; a rocking cam fixed to the top of the body and able to interact with the projecting end of the push-rod to control the movement thereof; means of rotary articulation inserted between the top of the body and the cam, which comprise a fixed clevis mount secured to the body and a moving clevis mount secured to the cam, the said clevis mounts being coupled together in such a way as to allow the cam to rock with respect to the body; a base surmounting the cam and secured thereto; and an operating handgrip secured into the base for manoeuvring the rocking cam.

BACKGROUND OF THE INVENTION

The invention is aimed in particular, although not exclusively, at hydraulic manipulators designed as mentioned above.

FIG. 1 of the appended drawings illustrates a known arrangement of a manually-operated remote-control device, in this case, more specifically a hydraulic manipulator. The device essentially comprises:

- a body 1 containing at least one (and in practice from one to four) moving member that generates a signal (a pressure reducer in the example of the hydraulic manipulator)—which is not visible in the drawing—when moved, especially linearly parallel to the axis of the body, between two extreme positions,
- a push-rod 2 associated with each generating member and projecting beyond the top of the body 1, this push-rod being engaged in a guide 3 supported by the body so as to be able to move substantially axially,
- a rocking cam 4 fixed to the top of the body and able to interact with the projecting end of the push-rod(s) to control the movement thereof when it is tilted;
- means 5 of articulation in tilting which are inserted between the top of the body and the cam 4, comprising a fixed clevis mount 5*a* secured to the body 1 (for example, the clevis mount 5*a* is fitted with a threaded stem 11 which is screwed into the body 1, passing through a hole 12 made in a top plate or attachment plate 13 that closes the body: the clevis mount 5*a*, screwed into the body 1, then also acts as means of attaching the plate 12 to the body 1) and a moving clevis mounts 5*b* secured to the cam, the said clevis mounts 5*a*, 5*b* being coupled together in such a way as to allow the cam 4 to rock with respect to the body; in practice, when there is one push-rod or two diametrically opposed push-rods, the clevis mounts 5*a*, 5*b* are articulated together by a simple pivot pin transverse to the axis of diametral alignment of the push-rods; when there are two, three or four push-rods arranged on two approximately orthogonal axes, the clevis mounts 5*a*, 5*b* are articulated together by a member for multi-directional inclination of the cam, such as a ball-joint or a cardan joint as schematically illustrated more particularly in FIG. 1;
- a base 6 surmounting the cam 4 and secured thereto; and
- a handgrip 7 comprising a grip part 7*a* and a rod 7*b* for mounting in the base 6.

In this particular embodiment, the articulation means 5, and in particular the moving clevis mount 5*b*, the cam 4 and the base 6 are constructed in the form of three independent components, machined separately, even made of different materials, and assembled together essentially by screwing: the base 6 is pierced axially at 8 and threaded internally; the cam 4 has a central recess at 9; the moving clevis mount 5*b* has a threaded rod 10; the cam 4 is slipped over the threaded rod 10 and locked on the moving clevis mount 5*b* by the base 6 which is screwed onto the threaded rod 10, and which thus forms the lock nut for the cam; then the rod 7*b* of the handgrip 7, which is threaded at its free end, is screwed into the base 6.

The result of this is that manufacturing the constituent components of the push-rod controls individually requires a great many and expensive machining operations, followed by an assembly operation which takes time and is therefore costly.

SUMMARY OF THE INVENTION

The object of the invention is essentially to provide an improved technical solution which, while being capable of fulfilling the necessary functions, allows a considerable reduction in the cost of producing that part of the control which moves the push-rods.

For these reasons, a remote-control device as mentioned in the preamble is essentially characterized, while being designed in accordance with the invention, in that the moving clevis of the articulation means, the cam and the base are constructed in the form of a single monobloc component.

Thanks to this design, the part for controlling the push-rods which is constructed as a single component can be manufactured under far simpler and more economical conditions, for example in the form of a casting with an additional machining operation only on a low number of surfaces. Mounting is thus simplified. The keeping of parts in stock is also simplified.

Finally, it proves that, thanks to the solution put forward by the invention, the cost price of the part for controlling the push-rods can, in practice, be reduced by approximately half.

It is possible to retain the customary way of mounting the push-rod-control part on the body and envisage for the fixed clevis mount of the articulation means to be screwed into the body; in general, the top of the body is closed by an attachment plate or top plate and the fixed clevis mount of the articulation means is screwed into the body through a hole in the attachment plate.

In this case, it is possible, here too, to retain a known method of mounting and contrive for the fixed clevis mount of the articulation means to comprise an annular shoulder bearing on the periphery of the hole in the attachment plate and for the attachment plate to be secured to the body by the screwing of the fixed clevis mount into the body. However, because of the monobloc structure of the component, it is possible that the distance between the annular bearing surface of the moving clevis mount and the surface via which the cam bears on the push-rods may not coincide exactly with the distance by which the push-rods project above the attachment plate; put another way, it is possible that once the fixed clevis mount has been screwed into the body in such a way as to lock the attachment plate thereto, the cam may not be correctly axially positioned with respect to the push-rods, and in particular may be bearing on the push-rods and causing them to be pushed in. It is then possible to envisage for at least one shim to be inserted between the attachment plate and the annular shoulder of the fixed clevis mount so that the cam is positioned exactly in contact with the projecting end of the push-rod.

In order to solve the problem of the correct axial positioning of the cam with respect to the push-rods, it is also possible to envisage not screwing the fixed clevis mount all the way into the body and for it to be screwed in only as far as is needed in order to bring the cam into contact with the push-rods; however, the attachment plate will no longer be locked by the fixed clevis mount. It is then possible to resort to the solution that consists in securing the attachment plate to the body by attachment means distinct from the fixed clevis mount of the articulation means and in locking the fixed clevis mount of the articulation means into the body using a curable pasty means or the like, in an axial position such that the cam is positioned exactly in contact with the projecting end of the push-rod.

It is also possible to contrive for that part of the monobloc component forming the mounting base for the handgrip to have an axial hole and for the handgrip to comprise a rod push-fitted into the said axial hole and locked in place by a radial screw screwed into the base. This then avoids internal threading of the part forming the base and this too results in a manufacturing economy.

BRIEF DESCRIPTION OF THE DRAWINGS

The invention will be better understood from reading the detailed description which follows, of a number of preferred embodiments that are given merely by way of non-limiting examples. In this description, reference is made to the appended drawings, in which.

DETAILED DESCRIPTION OF THE PREFERRED EMBODIMENTS

Figure 1:
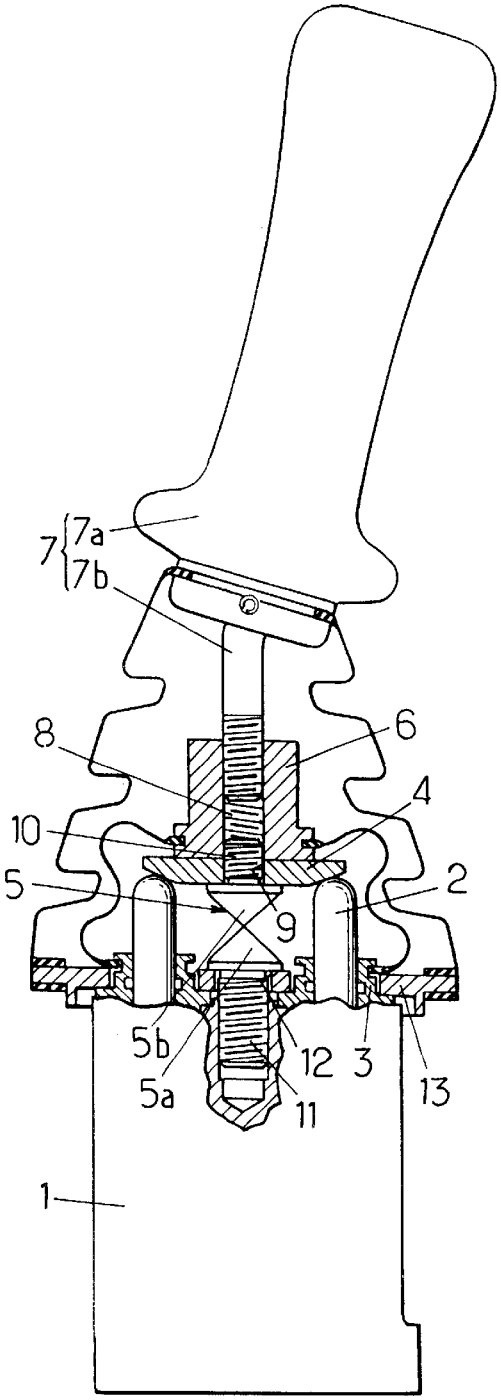
FIG.1. PRIOR ART
FIG. 1 is a view in part section of a manually-operated remote control device according to the prior art
Figure 2:
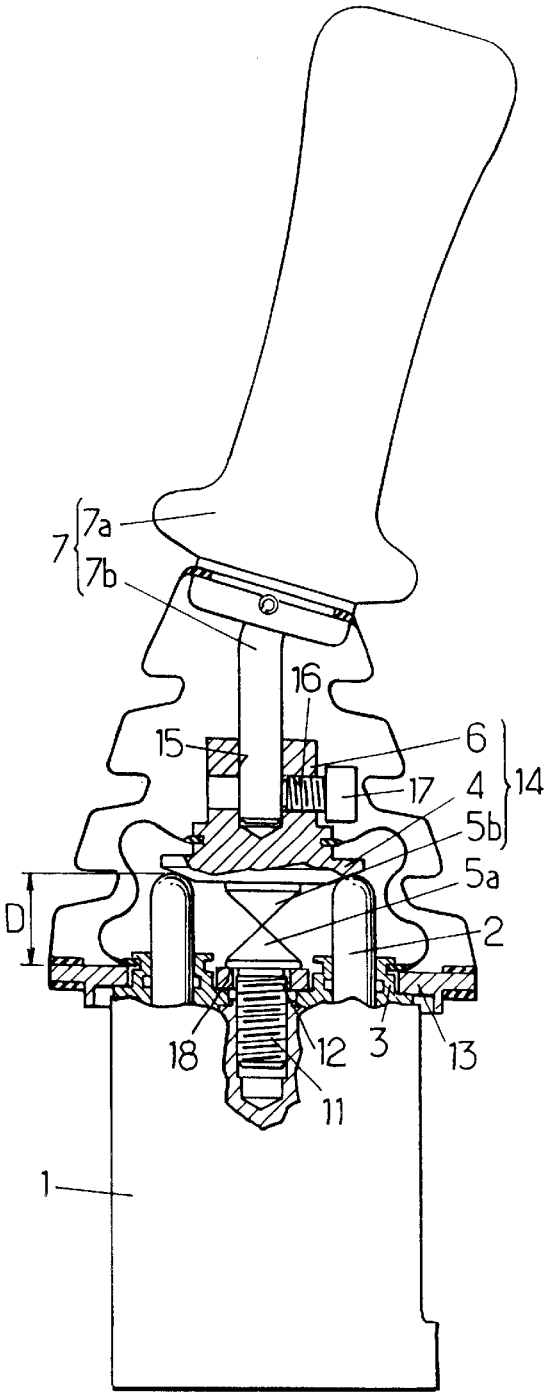
FIG. 2 is a view in part section similar to that of FIG. 1 and illustrating the design in accordance with the invention.

Referring now to FIG. 2, this depicts the same device as FIG. 1, namely, by way of example, a hydraulic manipulator, and the identical members are denoted therein by the same numerical references.

In the device depicted in FIG. 2, which is designed in accordance with the invention, the moving clevis mount 5*b*, the cam 4 and the base 6 constitute a single monobloc component 14 which may, in particular, in a simple and inexpensive way, be a casting with an additional machining operation on a few surfaces (bearing surface of the cam 4 in particular).

The base 6 is pierced with an axial hole 15, not threaded, able to accommodate as a push-fit the end of the rod 7*b* of the handgrip 7; a threaded radial hole 16 accepts a binding screw 17.

In the same way as in FIG. 1, the fixed clevis mount 5*a* of the articulation means 5 is equipped with a threaded stem 11 to be screwed into the body 1, through the hole 12 in the attachment plate or top plate 13 which closes the body 1. The fixed clevis mount 5*b* is equipped with an annular shoulder 18 which bears on the attachment plate 13 in such a way that the plate 13 is secured to the body 1 via the fixed clevis mount 5*b* screwed into the body 1.

This design, which is structurally far more simple than the design of the prior art, employs a monobloc component which is more simple to produce and requires less machining than the three assembled components employed hitherto and leads to more rapid assembly. The resulting financial saving is substantial.

In practice, however, there is the problem of ensuring the correct axial positioning of the component 14, that is to say correct axial positioning of the cam 4, with respect to the ends of the push-rods 2 with which it is to come into contact, at a tangent, but without pushing them in. Now, despite the accuracy of the machining operations performed on the component 4 and the fixed clevis mount 5*a*, it is possible that the distance between the bearing surface 18 and the resting surface of the cam 4 may be incorrect: if too great, a gap will remain between the resting surface of the cam and the end of the push-rods and will result in an undesirable dead time when the handgrip is tilted to control the corresponding pressure reducers; if too small, the cam in its neutral position will push the push-rods in and undesirably actuate the push-rods.

It is therefore necessary to provide means of adjustment allowing correct axial positioning of the component 14, if need be. In instances where the distance D is excessive, all that is required is for the shoulder 18 to be machined further in order to reduce this distance. By contrast, in instances where the distance D is insufficient, it is necessary to provide means allowing this distance to be increased.

Figure 3:
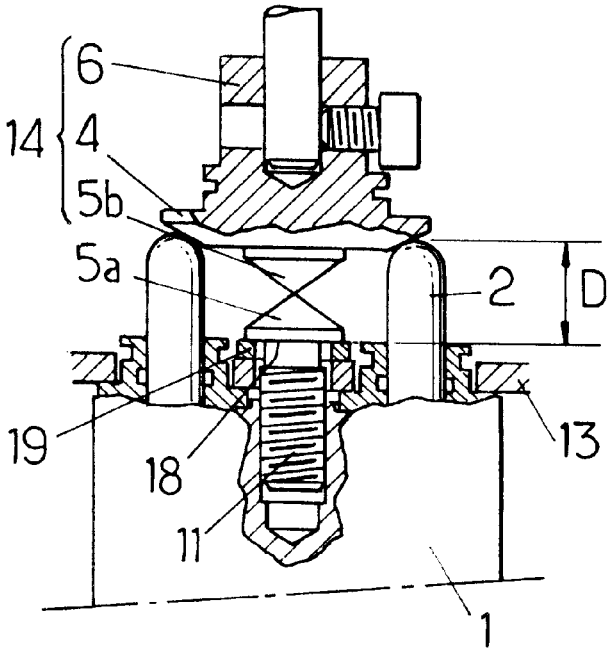
FIGS. 3 and 4 are partial views in section illustrating alternative forms of the design of FIG. 2.

In the example of FIG. 3, a shimming washer 19 has been inserted for this purpose under the shoulder 18 of the fixed clevis mount 5*a*, so as to raise the component 14 with respect to the body 1 and make sure that the resting surface of the cam lies at a tangent to the ends of the push-rods 2. In practice, a set of two or three shims of varying thicknesses must suffice for adjusting the positioning in production. The fixed clevis mount 5*a* still acts as a member for attaching the top plate 13 to the body 1.

Figure 4:
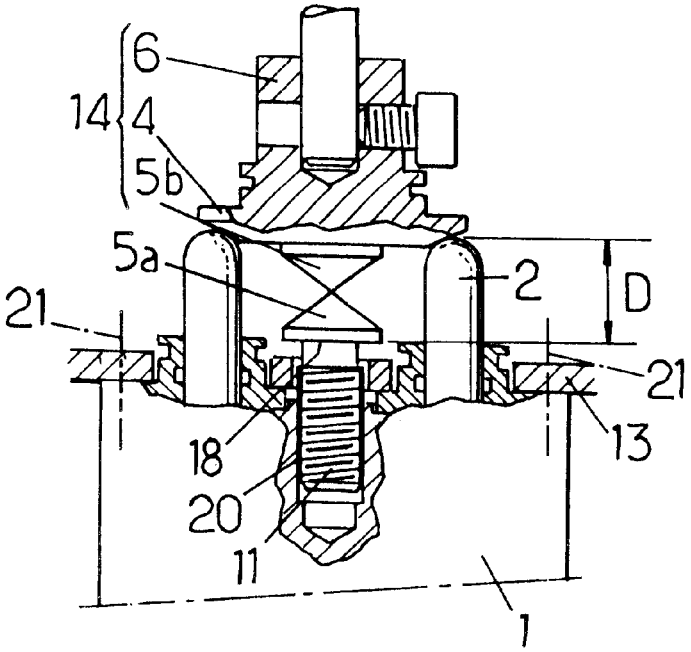

In the example of FIG. 4, the threaded stem 11 of the fixed clevis mount 5*a* is screwed into the body 1 with the insertion of an adhesive paste (depicted diagrammatically as 20) which, when dry, cures and blocks the threaded stem 11 in position in its housing. The fitting of the component 14 connected to the fixed clevis mount 5*a* can then be performed more simply, by screwing the clevis mount 5*a* into the body 1 until the cam 4 lies at a tangent to the end of the push-rods 2. However, in this case, the shoulder 18 of the fixed clevis mount 5*a* is not resting against the top plate 13 and can no longer serve to attach the plate 13 to the body 1. It is then necessary to provide distinct attachment means for securing the plate 13 to the body 1 (for example screws or bolts 21 depicted diagrammatically by their axis in FIG. 4).

As goes without saying and as is already obvious from the foregoing, the invention is not in any way restricted to those of its applications and embodiments which have been more specifically envisaged; on the contrary, it encompasses all alternative forms thereof.

I claim:

1. A manually-operated remote-control device, adapted for use as a hydraulic manipulator, comprising: a body (1) containing at least one moving member that generates a signal when moved between two extreme positions; at least one push-rod (2) associated with the generating member and projecting from the top of the body (1), this push-rod being guided (3) so that it can move substantially axially; a rocking cam (4) fixed to the top of the body (1) and able to interact with the projecting end of the push-rod (2) to control the movement thereof; means (5) of rotary articulation inserted between the top of the body (1) and the cam (4), comprising a fixed clevis mount (5*a*) secured to the body (1) and a moving clevis mount (5*b*) secured to the cam (4), the clevis mounts (5*a*, 5*b*) being coupled together in such a way as to allow the cam (4) to rock with respect to the body (1); a base (6) surmounting the cam (4) and secured thereto; and an operating hand grip (7) secured into the base (6) for maneuvering the rocking cam (4);

characterized in that the moving clevis (5*b*) of the articulation means, the cam (4), and the base (6) are constructed in the form of a single monobloc component (14).

2. The manually-operated remote-control device according to claim 1, characterized in that the fixed clevis mount (5*a*) of the articulation means is screwed (11) into the body (1).

3. The manually-operated remote-control device according to claim 2, characterized in that the top of the body (1) is closed by an attachment plate or top plate (13) and in that the fixed clevis mount (5*a*) of the articulation means is screwed into the body (1) through a hole (12) in the attachment plate (13).

4. The manually-operated remote-control device according to claim 2, characterised in that the top of the body (1) is closed by an attachment plate or top plate (13) and in that the fixed clevis mount (5*a*) of the articulation means is screwed into the body (1) through a hole (12) in the attachment plate (13), in that the attachment plate (13) is secured to the body (1) by attachment means (21) distinct from the fixed clevis mount (5*a*) and in that the fixed clevis mount (5*a*) is locked into the body using a curable pasty means (20), in an axial position such that the cam (4) is positioned exactly in contact with the projecting end of the push-rod (2).

5. The manually-operated remote-control device according to claim 1, charactarized in that that part of the monobloc component forming the mounting base (6) for the handgrip (7) has an axial hole (15) and in that the handgrip (7) comprises a rod (7*b*) push-fitted into the said axial hole (15) and locked in place by a radial screw (17) screwed into the base (6).

6. A manually-operated remote control device, adapted for use as a hydraulic manipulator, comprising: a body (1) containing at least one moving member to generate the signal when moved between two extreme positions; at least one push-rod (2) associated with the generating member and projecting from the top of the body (1), this push-rod being guided (3) so that it can move substantially axially; a rocking cam (4) fixed to the top body (1) and able to interact with the projecting end of the push-rod (2) to control the movement thereof; means (5) of rotary articulation inserted between the top of the body (1) and the cam (4), comprising a fixed clevis mount (5*a*) secured to the body (1) and a moving clevis mount (5*b*) secured to the cam (4), the clevis mounts (5*a*, 5*b*) being coupled together in such a way as to allow the cam (4) to rock with respect to the body (1); a base (6) surmounting the cam (4) and secured thereto; and an operating hand grip (7) secured into the base (6) for maneuvering the rocking cam (4);

characterized in that the moving clevis (5*b*) of the articulation means, the cam (4), and the base (6) are constructed in the form of a single monobloc component (14); and further characterized in that the top of the body (1) is closed by an attachment plate or top plate (13) and in that the fixed clevis mount (5*a*) of the articulation means is screwed into the body (1) through a hole (12) in the attachment plate (13), in that the fixed clevis mount (5*a*) of the articulation means comprises an annular shoulder (18) bearing on the periphery of the hole in the attachment plate (13), in that the attachment plate (13) is secured to the body (1) by the screwing of the fixed clevis mount (5*a*) into the body (1).

7. A manually-operated remote control device, adapted for use as a hydraulic manipulator, comprising: a body (1) containing at least one moving member to generate the signal when moved between two extreme positions; at least one push-rod (2) associated with the generating member and projecting from the top of the body (1), this push-rod being guided (3) so that it can move substantially axially; a rocking cam (4) fixed to the top body (1) and able to interact with the projecting end of the push-rod (2) to control the movement thereof; means (5) of rotary articulation inserted between the top of the body (1) and the cam (4), comprising a fixed clevis mount (5*a*) secured to the body (1) and a moving clevis mount (5*b*) secured to the cam (4), the clevis mounts (5*a*, 5*b*) being coupled together in such a way as to allow the cam (4) to rock with respect to the body (1); a base (6) surmounting the cam (4) and secured thereto; and an operating hand grip (7) secured into the base (6) for maneuvering the rocking cam (4);

characterized in that the moving clevis (5*b*) of the articulation means, the cam (4), and the base (6) are constructed in the form of a single monobloc component (14); and further characterized in that the top of the body (1) is closed by an attachment plate or top plate (13) and in that the fixed clevis mount (5*a*) of the articulation means is screwed into the body (1) through a hole (12) in the attachment plate (13), in that the fixed clevis mount (5*a*) of the articulation means comprises an annular shoulder (18) bearing on the periphery of the hole in the attachment plate (13), in that the attachment plate (13) is secured to the body (1) by the screwing of the fixed clevis mount (5*a*) into the body (1), and in that at least one shim (19) is inserted between the attachment plate (13) and the annular shoulder (18) of the fixed clevis mount (5*a*) so that the cam (4) is positioned exactly in contact with the projecting end of the push-rod (2).

* * * * *